United States Patent [19]

Asmus

[11] Patent Number: 4,559,690

[45] Date of Patent: Dec. 24, 1985

[54] PICTURE HANGING TOOL

[76] Inventor: Stewart Asmus, 135 N.W. 99 Way, Coral Springs, Fla. 33065

[21] Appl. No.: 515,849

[22] Filed: Jul. 21, 1983

[51] Int. Cl.[4] ..... B25B 33/00

[52] U.S. Cl. ..... 29/270; 29/281.1

[58] Field of Search ..... 29/267, 270, 278, 281.1; 254/131; 81/1 R, 3 R; 145/46

[56] References Cited

U.S. PATENT DOCUMENTS

| | | | |
|---|---|---|---|
| 1,983,790 | 12/1934 | Brooks | 254/131 X |
| 2,018,902 | 10/1935 | Schwedland | 29/267 X |
| 2,441,696 | 5/1948 | Feingold | 29/267 X |
| 2,581,534 | 1/1952 | Hungerford . | |
| 3,088,199 | 5/1963 | Lewis | 29/267 X |
| 3,257,716 | 6/1966 | Spytek | 29/267 |
| 3,406,460 | 10/1968 | Colwell . | |
| 3,516,165 | 6/1970 | Pfeffer . | |
| 4,077,105 | 3/1978 | Boyce, Jr. et al. | 29/278 |

*Primary Examiner*—James G. Smith
*Assistant Examiner*—Steven P. Schad
*Attorney, Agent, or Firm*—Henderson & Sturm

[57] ABSTRACT

A picture hanging device that releasably engages a picture hook and nail, from which a picture is suspended; and which positions the hooks and nail assembly, at almost the exact position they will assume, when the nail has been driven into a wall.

5 Claims, 4 Drawing Figures

PICTURE HANGING TOOL

BACKGROUND OF THE INVENTION

For most people, the task of hanging a picture at a desired height and distance from other pictures is anything but a simple chore. While the act of driving a nail through a picture hook is in itself simple, a certain mystique seems to surround the proper placement of the nail on the wall to insure that the picture will be disposed at the proper height when suspended from the hook.

All too often an individual will resort to the trial and error method, that while producing the desired result, invariably also results in numerous holes being punched into the wall surface. This procedure obviously is not the most desirable either from an aesthetic or practical standpoint, and many solutions have been proposed to overcome the inherent deficiencies of this practice.

In an attempt to simplify the aforementioned task, a variety of marking devices have been developed to pre-mark the location of the nail prior to it being driven into a wall. Some examples of these marking devices may be seen by reference to U.S. Pat. Nos. 3,516,165; 2,581,534 and 3,406,460.

While these devices are adequate for their intended purpose; they have failed to realize, that they require an additional and unnecessary step, in an otherwise simple procedure.

The one fact that has been overlooked in the development of the aforementioned devices is that the picture hook and nail, that will eventually support the picture at the desired location, can be used to pre-position the picture prior to the nail being driven, if a tool was specifically developed to accomplish that goal.

The present invention was developed in direct response to that oversight, and represents a unique advancement and improvement in the art.

SUMMARY OF THE INVENTION

An object of the present invention is to provide a very simple tool that will greatly simplify the chore of positioning a picture hook at the proper location to support a picture frame.

Another object of the present invention is to provide a releasable picture hook supporting device that can be used to position both the hook and the picture frame at almost the exact location they will assume when the hook is secured to a wall member.

Still another object of the present invention is to provide a device that will releasably support both a picture hook and nail, yet also allow the nail to be partially driven into a wall member.

A further object of the present invention is to provide a device that will support a picture hook, picture nail and picture frame in a desired location using only one finger.

A still further object of the preent invention is to provide a device that is simple and inexpensive to manufacture, easy to use, and which will overcome all of the inherent deficiencies found in the prior art devices.

Yet another object of the present invention is to provide a device, that will greatly simplify what heretofore has been a chore that most people dreaded doing, and which normally produced unsatisfactory results, either with or without mechanical aids.

These and other objects, advantages and novel features of the invention will become apparent from the detailed disclosure that follows, when considered in conjunction with the accompanying drawings.

DETAILED DESCRIPTION OF THE PREFERRED EMBODIMENT

As can be seen by reference to the drawings, the picture hanging tool that forms the basis of the present invention is designated generally as 10; the tool 10 comprises a generally flat elongatd rigid member 11, having a curved hook portion 12 formed on one end.

In the embodiment shown, the rigid member 11 is preferably formed from a length of plastic having a minimum thickness of approximately one-eighth of an inch ($\frac{1}{8}''$). The curved hook portion 12 is an integral part of the elongated rigid member 11, and may be formed either in the initial molding process; or subsequent thereto, by heating the end 13 of the rigid member 11 to soften the plastic material, and then deforming the plastic about a curved surface to form the hook portion 12.

Figure 2:
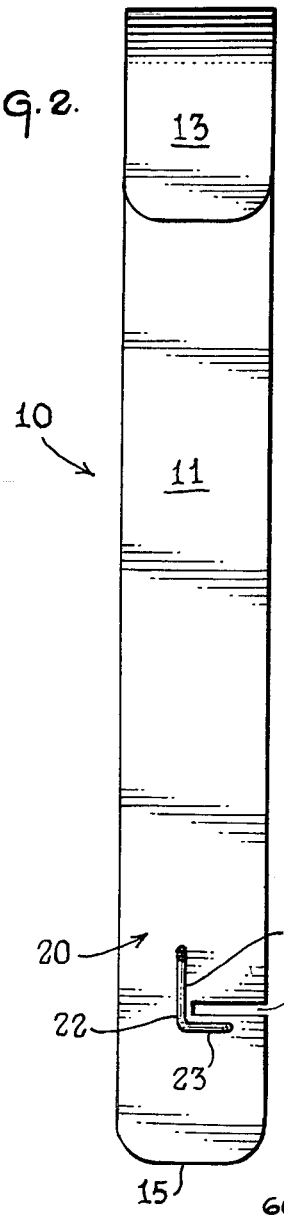
FIG. 2, is a front plan view of the tool.
Figure 1:
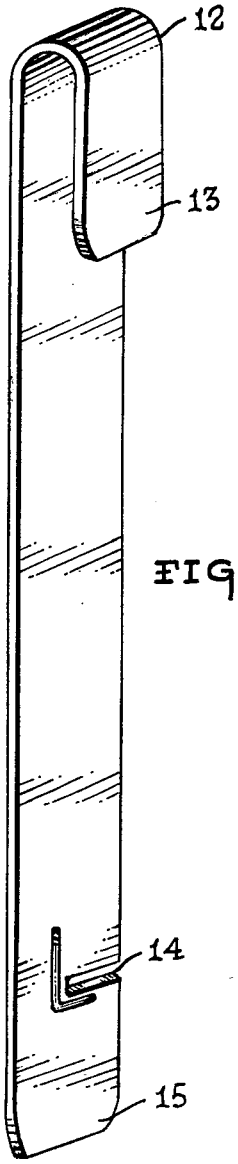
FIG. 1, is a perspective view of the new picture hanging tool.
Figure 3:
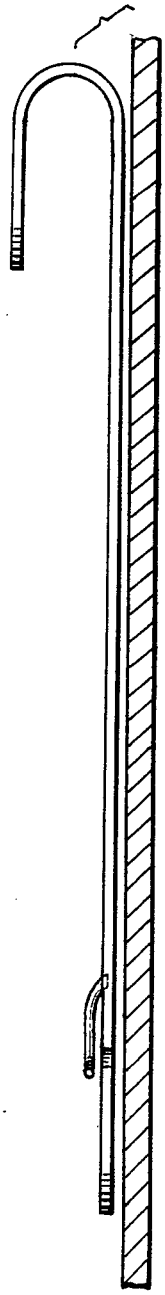
FIG. 3, is a side plan view of the tool.

As can best be seen in FIGS. 1 and 2, the rigid member 11 is further provided with a slot 14 formed on one of its elongated sides. The slot 14 has a generally elongated rectangular shape, and extends beyond the midpoint of the elongated rigid member 11, and is disposed proximate to, but spaced from, the flat end 15 of the rigid member 11.

In addition to the above, the rigid member 11 is further provided with a picture hook receiving means 20, disposed adjacent to the slot. The picture hook receiving means 20 comprises a generally L-shaped member 21 having a downwardly depending leg 22, that is connected at its uppermost portion to the rigid member 11; but whose remaining length is disposed parallel to, and spaced from, the rigid member 11. The actual picture hook engaging means, of the picture hook receiving means 20, comprises a horizontally disposed leg 23, that is disposed below, parallel to, and spaced from, the elongated slot 14 in the rigid member 11.

Figure 4:
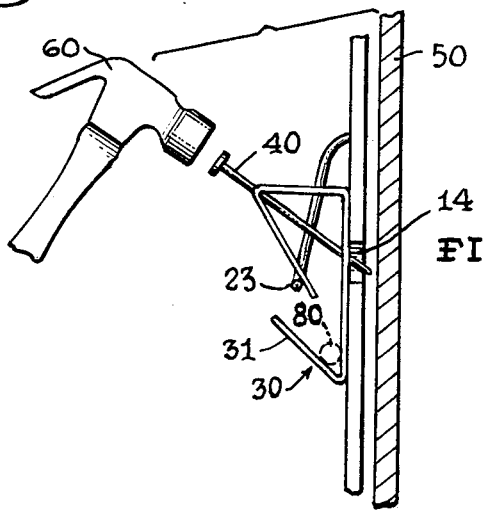
FIG. 4, is an enlarged detail view of a picture hook and nail positioned in the device.

As can best be seen by reference to FIG. 4, the horizontal leg 23 of picture hook receiving means 20 is spaced from the rigid member 11; in order that it may slidingly receive a picture hook 30, so that the apertures (not shown) in the picture hook are aligned at an angle with respect to the slot 14. The aforementioned alignment of the apertures with respect to the slot 14 allows a driveable member 40 (such as a nail) to extend through the apertures, and the slot 14 to contact a wall surface 50 on the opposite side of the slot. A driving means 60 may then be used to transmit force to the driveable member, to cause the driveable member to penetrate the wall surface on the opposite side of the slot 14.

As mentioned supra, the elongated slot 14 entends beyond the mid-point of the rigid member 11, and the reason for this is to allow the picture hook 30 to be positioned, such that the picture hook apertures may be aligned with the mid-point of the rigid member 11.

The operation of this device is quite simple, and proceeds as follows: a picture hook and nail is slidingly engaged by the horizontally disposed leg 23, with the driven member or nail 40 being aligned with the slot 14;

the picture hook and nail are then positioned at the mid-point of the device, and a wire 80 (shown in phantom) attached to a picture frame is engaged by the hook portion 31 of the picture hook in a well recognized fashion; the user then inserts one or more fingers into the hook portion 12, to suspend and support all of the aforementioned elements, until the user is satisfied with the position of the picture on the wall; the user then removes the picture and wire from engagement with the picture hook, while retaining the device 10 at the selected position; the driving means or hammer 60 is then used to transmit force to the driveable member or nail 40 to partially penetrate the wall surface 50; the device 10 is then moved out of engagement with the picture hook and nail, and the nail is then driven into the wall to the extent permitted by the picture hook.

As mentioned previously, the preferred minimum thickness of the device is approximately one-eighth of an inch and this dimension is also the preferred maximum thickness. Since this device is intended to be fabricated from plastic, the specified thickness will lend strength to the structure, however, since the picture hook will be spaced from the wall, by the thickness of the device, prior to the nail being driven, it is imperative that the device be as thin as possible, to insure that the initial and final positions of the picture hook are virtually identical.

It should also be appreciated, that by virtue of the unique construction heretofore described, it is not necessary to insert the driveable member into the picture hook, while the picture is being positioned. The construction of the device 10, allows the picture to be suspended with, or without, the nail in place; and in most instances, it would be advisable to omit the nail, so that the wall surface is not scratched as the picture is moved from one location to another. Obviously, once the desired cover position is selected; the picture can be removed from the picture hook; the nail can be inserted into the picture hook and the driving means can then be brought into play, to secure the picture hook and nail in the desired location.

Having thereby described the subject matter of this invention, it should be obvious that many substitutions, modfications, and variations of the invention are possible in light of the above teachings. It is therefore to be understood, that the invention as taught and described is only to be limited to the extent of the breadth and scope of the appended claims.

What I claim is:

1. A picture hanging tool for use in conjunction with, a picture frame, a picture hook, a driving means, and a driveable member, wherein the tool comprises:

A generally flat elongated rigid member having a curved hook portion formed on one end and dimensioned to partially encompass a portion of a users hand; a slot formed on one of the elongated sides of said rigid member proximate to, but spaced from, the other end, wherein said slot is dimensioned to receive said driveable member; and, a picture hook receiving arm projecting outwardly from said rigid member wherein a portion of said picture hook receiving arm is disposed parallel and adjacent to, but spaced from said slot, for the purpose of supporting said picture hook and said driveable member such that the driving means can drive the driveable member through said slot.

2. A picture hanging tool as in claim 1; wherein, the slot has a generally elongated rectangular shape, and terminates at a point beyond the mid-point of the elongated rigid member.

3. A picture hanging tool as in claim 1; wherein, the picture hook receiving arm supports the picture hook, so that apertures formed in said picture hook for receiving a driveable member, are aligned with said slot.

4. A picture hanging tool as in claim 3; wherein, the driving means can transmit force to a driveable member, disposed in said picture hook to cause the driveable means to penetrate a surface on the opposite side of the slot.

5. A picture hanging tool as in claim 1; wherein, said picture hook receiving arm releasably supports the picture hook adjacent said slot.

* * * * *